United States Patent [19]

Schade

[11] 4,184,811

[45] Jan. 22, 1980

[54] FLEXIBLE-WALL FUEL PUMP WITH MEANS TO DAMPEN WALL OSCILLATIONS

[76] Inventor: Maynard W. Schade, Rte. 1, 1311 Co. Tk. Hwy., Edgerton, Wis. 53534

[21] Appl. No.: 785,289

[22] Filed: Apr. 6, 1977

[51] Int. Cl.[2] ..... F04B 43/10; F04B 45/06

[52] U.S. Cl. ..... 417/394; 417/478; 123/139 A

[58] Field of Search ..... 417/394, 478, 395; 92/13.2, 13.6; 123/139 A

[56] References Cited

U.S. PATENT DOCUMENTS

| | | | |
|---|---|---|---|
| 2,405,734 | 8/1946 | Coe | 417/394 |
| 2,496,711 | 2/1950 | Goddard | 417/395 |
| 3,048,121 | 8/1962 | Sheesley | 417/478 |
| 3,158,104 | 11/1964 | Hutchinson | 417/478 |
| 3,951,572 | 4/1976 | Ray et al. | 417/478 |
| 3,983,857 | 10/1976 | O'Connor | 417/478 |

FOREIGN PATENT DOCUMENTS

| | | | |
|---|---|---|---|
| 1177065 | 4/1959 | France | 92/13.2 |

*Primary Examiner*—Carlton R. Croyle
*Assistant Examiner*—Thomas I. Ross
*Attorney, Agent, or Firm*—Keith Schoff

[57] ABSTRACT

An adjustable mechanical damper for the diaphragm of a fuel pump of a type in which the diaphragm is pulsated by fluctuations in engine crankcase pressure is provided to regulate the amplitude of diaphragm pulsations and the incremental volumetric change produced in the diaphragm-enclosed chamber by the pulsations. Provision of the damper renders the fuel pump self-compensating for changes in fuel head pressure and insures constancy in the output response of the fuel pump to crankcase pressure.

4 Claims, 2 Drawing Figures

FLEXIBLE-WALL FUEL PUMP WITH MEANS TO DAMPEN WALL OSCILLATIONS

FIELD OF INVENTION

Combustible air-and-fuel mixture is directed in a two stroke cycle internal combustion engine via communication ports from the engine carburetor through the crankcase and into the cylinders. A type of fuel pump which is popularly used with single cylinder two stroke cycle engines such as model airplane engines comprises a pulsated expansible tubular diaphragm fitted with appropriate check valves for placement in the fuel line between the fuel tank and carburetor of the engine. Within the fuel pump housing an annular space surrounds the diaphragm and is communicated to the engine crankcase to subject the diaphragm to pressure fluctuations which emanate from the engine crankcase and produce pulsed expansion and contraction of the diaphragm and incremental volumetric change in the diaphragm chamber. The pumping action of the chamber provides positive pressure delivery of fuel to the carburetor.

BACKGROUND OF INVENTION

Regulating the fuel-to-air ratio of a carbureted mixture through a range of throttle settings is difficult, especially for engines equipped with non-metering, non-aspirating carburetors in which fuel is continuously sprayed under pressure into an air stream. Placing a pressure regulator in the fuel line suffers the disadvantage that the flow throttling passage constriction embodied in a pressure regulator impedes flow of fuel at full throttle settings and limits the maximum power which can be obtained from an engine.

SUMMARY OF THE INVENTION

A pulsed diaphragm fuel pump is equipped with a mechanically adjustable damper extending through the fuel pump housing for contacting the diaphragm and lessening the amplitude of vibrations induced in the diaphragm by fluctuations in crankcase pressure and reducing the incremental volumetric change produced in the diaphragm chamber. The volumetric change dynamically produced by pressure pulsations is self-compensating for the volumetric change statically produced in the chamber by change in fuel head pressure, whether resulting from change in fuel level in the fuel tank or from elevational change of the fuel tank.

DESCRIPTION OF THE INVENTION

In crankcase scavenged two stroke cycle internal combustion engines, carbureted fuel-and-air mixture is conveyed into the crankcase through a port which is opened during upward travel of the piston in the cylinder and closed during downward travel of the piston. The port may be disposed either in the cylinder wall for being covered and uncovered by the reciprocating piston or may be disposed in the engine crankshaft when the crankshaft is drilled for passage of the carbureted mixture. After the crankshaft inlet port is closed during downward travel of the piston in the cylinder, further downward movement of the piston compressed the mixture in the sealed crankcase and forces it through a further port in the cylinder wall which is uncovered by continued downward movement of the piston, into the partial vacuum created in the cylinder by downward piston travel. Sub-atmospheric pressure can then exist in the crankcase, and in greatest degree during engine idle when the carburetor passage is constricted by partial closing of the throttle valve. The effect of the cyclic compression and evacuation of the crankcase environment is to create very pronounced pressure pulsations which can be used, through means of a crankcase tap, to drive the diaphragm of a fuel pump.

Figure 1:
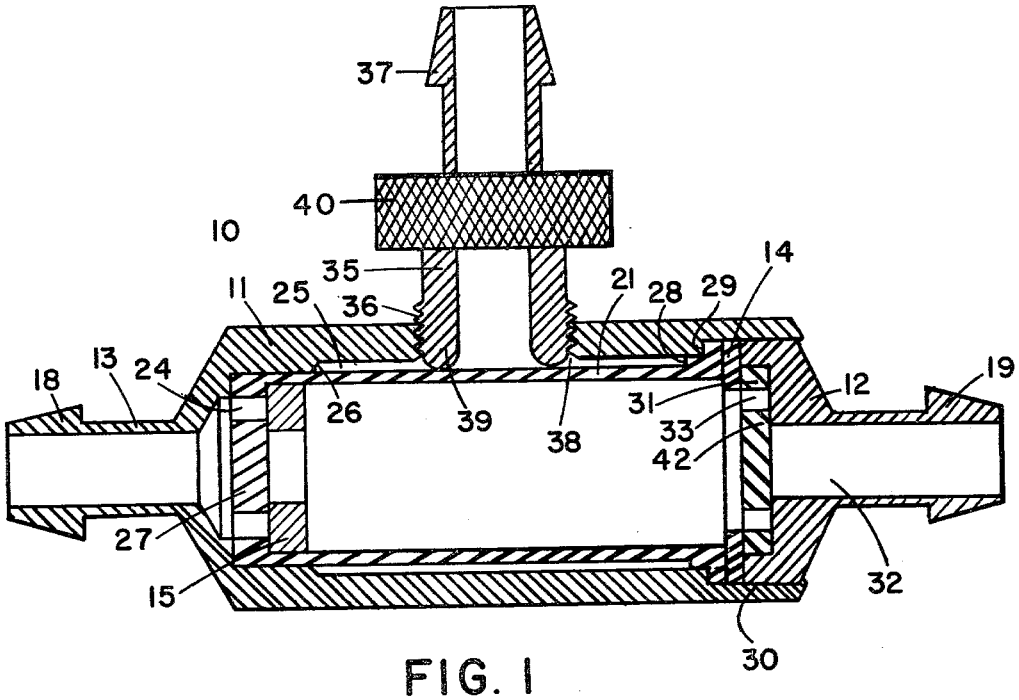
FIG. 1 is a cross-sectional elevation of an embodiment of a fuel pump of this invention.

Referring to FIG. 1, fuel pump 10 comprises rigid shell configured body 11 of elongated center portion and reduced diameter end portion 13. Closure member 12 is fitted into open bore 30 at the opposite end extremity of body 11, secured therein by swaging of the end extremity of body 11 to provide a lip peripherally secured against the outboard face of member 12. End portion of body 11 and closure member 12 are both configured to receive and frictionally retain attached tubing by provision of tapered nipple portions 18 and 19, respectively, tubing attachment being made to the carburetor and fuel tank, respectively, of the engine on which fuel pump 10 is an accessory.

Resiliently expansible tubular diaphragm 21 is disposed with body 11, separated annularly along the preponderant portion of its length from body 11 by annulus 25. A preferred material for mold casted diaphragm is silicone rubber of about 50 durometer softness reading. A membrane suitable for use in a fuel pump of a two stroke cycle engine of fractional cubic inch displacement, e.g. one-quarter cubic inch displacement as commonly used for model airplanes, might be from 0.3 inch to 0.5 inch in length and about 0.225 inch internal diameter with a wall thickness of about 0.015 inch. The membrane might be proportionately increased in size for use with larger size engines such as used in lawn mowers, chain saws, snowmobiles, outboard motors, motorcycles, etc.

Figure 2:
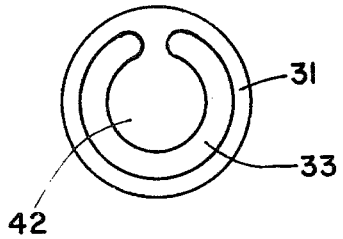
FIG. 2 is an elevation of a check valve member of the embodiment of FIG. 1.

Retaining ring 15 is disposed internally of membrane 21, press fitted into place to fix the membrane in the bore of reduced diameter formed by shoulder 26 in body 11. End closure check valve portion 24 is integrally molded into the discharge end of membrane 21 and comprises hinged flap portion 27 which closes against retaining ring 15 and opens by swinging to the left as viewed in FIG. 1. Check valve 31 disposed at the inflow end of membrane 21 recessed in closure member 12 is shown in FIG. 2, and in salient features is similar to check valve portion 24. Flap portion 42 is hinged integrally to peripheral portion 31 with the two portions being separated except at the hinge by annulus 33. Flap portion 42 seats against the inboard face of closure member 12 and opens to the left as viewed in FIG. 1 similarly to valve portion 24, enabling fluid to flow leftward through fuel pump 10 as shown and preventing back-flow of fluid in the opposite direction.

Membrane 21 is diametrically enlarged adjacent the inlet end of pump body 11 by the provisions of shoulders 28 and 29 which provide a snug fit and seal for the diaphragm within the bore and counterbore of body 11. Retaining ring 14 compressively abuts the annular end faces of membrane 21 and valve member 31 seating and tightly sealing the two members within fuel pump 10.

Tubing nipple portion 37 is provided on fitting 35 which protrudes transversely and upward as shown from the mid-portion of body 11 to provide communicating connection between the interior of the engine crankcase and annulus 25. Threaded base portion 36 of fitting 35 sealably engages threaded opening 38 in body 11 and knurled ring portion 40 provides means for manual turning of fitting 35 into greater or lesser engagement with membrane 21. Contact between smooth, rounded, non-abrading end extremity 39 of fitting 35 and membrane 21 dampens and reduces the amplitude of vibrations induced in the membrane by pressure fluctuations communicated from the engine crankcase to annulus 25. The response of membrane 21 to surges in external pressure is diminished in proportion to the degree with which fitting 35 interferes with the amplitude of diametrical expanding and contracting movement of membrane 21, and correspondingly the incremental volumetric change effected in the confine of member 21 by the pulsation is decreased proportionately, resulting in regulation of the volumetric pumping capacity of fuel pump 10 for each pressure pulse. Volumetric regulation so achieved is self-compensating for changes in fuel head pressure which result from raising or lowering the fuel level in the fuel tank or elevationally changing the fuel tank with respect to the fuel pump. Changes in static fuel head pressure expand or contact the diameter of membrane 21 and cause a corresponding increase or decrease in the deflection of membrane 21 resulting from contact with non-yielding fitting 35. Thus, the effects of static pressure change from variation in fuel head pressure compete with dynamic pressure fluctuations communicated from the engine crankcase to provide, in a properly designed system, exact balancing of effect and self-compensation and constancy of response in volumetric pumping of fuel by fuel pump 10 to engine speed independent of fuel head pressure. Such constancy of response is of primary importance, for example, in model airplane engines which utilize carburetors which are sensitive to flooding when fuel flow to the carburetor increases without causative increase in engine speed, but rather solely because of increase in fuel head pressure, and which provide the engine with too little lubricant, which is mixed with the fuel, for proper lubrication if the carbureted mixture is too lean because of reduction in fuel head pressure. The provision of volumetric flow control in the described manner provides the additional advantage over pressure regulated control by providing unimpeded connections between the fuel pump and carburetor free of flow throttling constrictions which characterize pressure regulators.

Application of a mechanical damper to a flat or otherwise configured diaphragm may be made, but is not preferred because lesser degree of control is obtained. In operation, an engine run at idle speed will experience relatively more extreme sub-atmospheric crankcase pressure tahn when the same engine is operated at full throttle, at upward from twelve thousand revolutions per minute for model airplane engines, and the mean expansion of the fuel pump diaphragm will be correspondingly greater at idle speed than at full throttle setting, but greater diaphragm expansion will produce a greater deflection of the diaphragm by fitting 35 and proportionately reduce the incremental volumetric change experienced cyclically by the membrane to compensate for the greater absolute volume due to membrane expansion. The two effects can be engineered to be self-compensating to provide constancy of response to engine speed alone in similar manner as described relative to changes in fuel head pressure.

I claim:

1. A fuel pump self-compensated for changes in fuel head pressure for use with two stroke cycle engines comprising in combination:

(a) a relatively rigid shell-like body member, (b) a resiliently expansible diaphragm disposed within said body member wherein said diaphragm defines a spacial confine which is variably expandable and contractable responsively to differential fluid pressure acting thereon, (c) first check valve means porting said confine defined by said diaphragm, (d) second check valve means porting said confine defined by said diaphragm, (e) a volume confined by said body member and interspaced between a preponderant portion of said diaphragm and said body member, (f) mechanical damper means adjustably retained by said body member for being set to project fixedly through varying distances into said volume to contact said diaphragm and produce deflection therein proportionate to the amplitude through which said spacial confine is variably driven in expansion by said fluid pressure differential, thereby to dampen expansion and contraction oscillations of said spacial confine, (g) an opening provided in said body member for communicating said volume with the environment of the crankshaft of an engine to which said fuel pump may be attached for use, thereby to provide pulsated drive operation of said diaphragm.

2. The device of claim 1 wherein said body member comprises closures which communicate said first check valve and said second check valve with external environment.

3. The device of claim 1 wherein said mechanical damper means comprises communicating fitting threaded into said opening provided in said body member.

4. The device of claim 1 wherein said diaphragm is of substantially tubular configuration.

* * * * *